US007883453B1

(12) United States Patent
Cooper

(10) Patent No.: US 7,883,453 B1
(45) Date of Patent: Feb. 8, 2011

(54) PORTABLE, BED MOUNTABLE EXERCISE STRAP

(76) Inventor: Tony Cooper, 12255 Claude Court Apt. 812, Northglenn, CO (US) 80241

( * ) Notice: Subject to any disclaimer, the term of this patent is extended or adjusted under 35 U.S.C. 154(b) by 0 days.

(21) Appl. No.: 12/006,027

(22) Filed: Dec. 31, 2007

(51) Int. Cl.
*A63B 26/00* (2006.01)

(52) U.S. Cl. ..... 482/140; 482/904; 482/39

(58) Field of Classification Search ..... 482/39, 482/139, 51, 62, 79, 91, 148, 92, 142, 904, 482/907–908, 910
See application file for complete search history.

(56) References Cited

U.S. PATENT DOCUMENTS 1,746,111 A * 2/1930 Fisher ..... 482/131
2,335,290 A * 11/1943 Medaris ..... 601/33
2,340,666 A * 2/1944 Johanson ..... 482/79
2,459,497 A * 1/1949 Calabro ..... 24/72.5
2,843,858 A * 7/1958 Bjorklund ..... 5/662
3,134,592 A * 5/1964 Sharkey ..... 482/140
3,523,310 A * 8/1970 Shead ..... 5/651
3,817,245 A * 6/1974 Kroeger ..... 128/876
4,116,434 A * 9/1978 Bernstein ..... 482/140
4,185,816 A * 1/1980 Bernstein ..... 482/140
4,212,458 A * 7/1980 Bizilia ..... 482/140
4,276,667 A * 7/1981 Osbourne ..... 5/498
4,383,343 A * 5/1983 Kulka ..... 5/648
4,468,022 A * 8/1984 Wu ..... 482/140
4,611,804 A * 9/1986 Addair ..... 482/131
4,705,270 A * 11/1987 Melton ..... 482/140
4,765,005 A * 8/1988 Hippel ..... 5/648
4,925,184 A * 5/1990 McJunkin et al. ..... 482/60
5,160,306 A * 11/1992 Lui ..... 482/140
5,295,276 A * 3/1994 Richards et al. ..... 5/648
5,820,519 A * 10/1998 Slenker ..... 482/4
5,820,532 A * 10/1998 Oliver ..... 482/123
6,152,855 A * 11/2000 Dean et al. ..... 482/4
6,228,004 B1 * 5/2001 Steinbach et al. ..... 482/121
6,241,642 B1 * 6/2001 Slenker ..... 482/114
6,270,445 B1 * 8/2001 Dean et al. ..... 482/4
6,890,289 B2 * 5/2005 Spinosa ..... 482/140
7,004,893 B1 * 2/2006 Waters ..... 482/140
7,172,540 B2 * 2/2007 Nguyen ..... 482/140
7,258,653 B2 * 8/2007 Brandon et al. ..... 482/142
7,632,222 B1 * 12/2009 Crognale ..... 482/142
7,637,854 B2 * 12/2009 Jang ..... 482/142
2003/0224912 A1 * 12/2003 Zagone ..... 482/80
2004/0014570 A1 * 1/2004 Centopani ..... 482/140
2005/0148437 A1 * 7/2005 Ryan et al. ..... 482/37
2008/0119338 A1 * 5/2008 Prsala ..... 482/142
2008/0176721 A1 * 7/2008 Boren ..... 482/92

* cited by examiner

*Primary Examiner*—Lori Baker

(57) ABSTRACT

An adjustable strap, detachably installed atop a mattress to serve as an aid for exercise, without having to alter the construction of the mattress or bed frame. The apparatus is utilized for sit-up exercise by an individual reclining upon the mattress. Each end of the strap forms a loop by means of a Velcro fastener of sufficient dimensions that the size of the loop can be varied. The loops are secured to the bed frame. A padded central portion is provided upon the strap, which is wide enough to accommodate a pair of ankles. Means are associated with the strap for spacing the strap from the mattress to provide a space into which the feet and ankles of the user can extend. A flat, semi rigid pad is provided, for the individual to sit atop the mattress without compressing the mattress during exercise.

4 Claims, 3 Drawing Sheets

PORTABLE, BED MOUNTABLE EXERCISE STRAP

FIELD OF THE INVENTION

The present invention pertains to portable exercise devices and, more particularly, to exercise devices which may be detachedly mounted to a bed so as to allow exercise, thereby providing an anchor for the feet and ankles of an individual engaging in sit-up exercises while in bed.

Specifically, the invention relates to exercise apparatus which can be readily installed on a mattress and utilized by an individual reclining on the mattress without requiring that the apparatus be sewn or otherwise secured to the mattress, the invention permitting the user to bring his or her body into a comfortable position and to be retained in such position. The present exercise apparatus tends to maintain its proper operative position atop the mattress when force is applied to the apparatus by an individual during use, and can be utilized without the aide of an attendant.

BACKGROUND OF THE INVENTION

Sit-up exercise is a common exercise for building abdominal muscles. It is particularly used for sports and military personnel trainings. It is an exercise that can be performed conveniently without equipment, and space requirement. While many individuals are performing sit-up type exercises as part of an exercise regimen, it is oftentimes difficult to maintain a proper sit-up position where the heels are in contact with a base plane. While the individual can extend his feet beneath a heavy object such as a piece of furniture or can enlist the aid of an assistant to maintain contact with the base plane, these options are not always available and can be somewhat uncomfortable to the individual.

Various devices have been developed over the years in attempts to enable the individual to properly and comfortably perform sit-up type exercises. Many of these devices are of the type which engage the lower portion of a door to provide an anchor for the one or more of the individual's feet. An example of such a device is shown in U.S. Pat. No. 3,134,592 to Sharkey, which discloses a foot-restraining device mounted on the footboard of the bed to facilitate exercise. However, the device is relatively inflexible in regard to the position relative to the footboards and the area for accommodating the feet of the patient for exercise purposes. Further, U.S. Pat. No. 4,611,804 to Addair illustrates the multiple strap array for mattresses with hand loop projections, which requires mattress removal and handling for installation.

Additionally, McJunkin Jr, et al's U.S. Pat. No. 4,925,184 describes a bed mountable exercise device provided with bicycle type pedals. Another illustration of a bed mounted strap is within U.S. Pat. No. 4,383,343 to Kulka, showing a strap, which provides support for the bedding to be held above the feet. Other anchoring devices for sit-up type exercises which have foot engaging means mounted on U-shaped brackets which are adapted to be secured to the bottom of a door by clamping means are disclosed in U.S. Pat. Nos. 4,116,434 and 4,185,816 to Bernstein; U.S. Pat. No. 4,212,458 to Bizilia; and U.S. Pat. No. 4,468,022 to Wu. A further door mounted device is shown by Melton in U.S. Pat. No. 4,705,270 which provides a rigid element captured by a door bottom.

Another portable exercise apparatus is shown in U.S. Pat. No. 7,004,893 of Waters, disclosing an exercise strap for use by two individuals engaging feet together against a base plate.

Accordingly, it would be highly desirable to provide an improved exercise apparatus, which can be readily installed in operative position on a bed and be utilized by bedridden or comfortably reclining individuals to perform simple exercises while in bed, with little or no assistance from attendants. Therefore, it is anticipated that there is a need for a simple, portable bed mountable exercise accessory, which can assist individuals in performing sit-up exercise. It is desirable to have such equipment to be lightweight, compact, attractive, inexpensive, easy to operate and transport, and operative in a comfortable environment.

SUMMARY OF THE INVENTION

In summary, an exerciser is more likely to perform exercises when it is more comfortable to do so. When the present invention is actively utilized by bedridden exercisers, an exercise can be done that may not be otherwise obtainable. Accordingly, the present invention provides for a light weight exercise aid adapted for use to ordinary beds, to reliably enhance the availability of comfortable exercise routines.

The present invention comprises a novel padded strap, which permits the user to maintain his or her body in a comfortable position while lying in bed. The strap can be formed of any suitable material, and in primary form, the invention has VELCRO fastening portions on opposite ends of the strap, which can be secured to provide a quick release anchor for mounting on the bed frame. Flexible loops projecting from the web strap engage the space between the box spring and the mattress, thereby allowing positioning of the strap atop the mattress. Thus, there is provided a space between the mattress and beneath the strap into which the feet and ankles of the user can extend.

It is a principal object of the invention to provide a portable improved exercise apparatus for use by individuals reclining in bed, which apparatus is lightweight, of compact storage, and which can be quickly and conveniently installed in operative position on a bed without the use of hand tools or other equipment, comprising an elongated webbing strap body, including a padded element enclosed in a flexible cover, and both ends of the strap each form a loop. Each loop is secured to the bed frame by a hook-and-loop type fastener of sufficient dimension that the size of the loop can be varied.

In view of the foregoing disadvantages inherent in the known types of sit-up type exercise aids present in the prior art, the present invention provides an easily adaptable aid, and overcomes the above-mentioned disadvantages and drawbacks of the prior art. As such, the general purpose of the present invention, has many novel features that result in a apparatus which is not anticipated, rendered obvious, suggested, or even implied by the prior art, either alone or in any combination thereof. Numerous objects, features and advantages of the present invention will be readily apparent to those of ordinary skill in the art upon a reading of the following detailed description of current embodiments of the present invention when taken in conjunction with the accompanying drawings. This invention is capable of other embodiments and of being practiced and carried out in various ways. Also, the phraseology and terminology employed herein are for the purpose of descriptions and should not be regarded as limiting. These together with other objects of the invention, along with the various features of novelty that characterize the invention, are pointed out with particularity in the claims annexed to and forming a part of this disclosure

DETAILED DESCRIPTION OF THE PREFERRED EMBODIMENT

Figure 3:
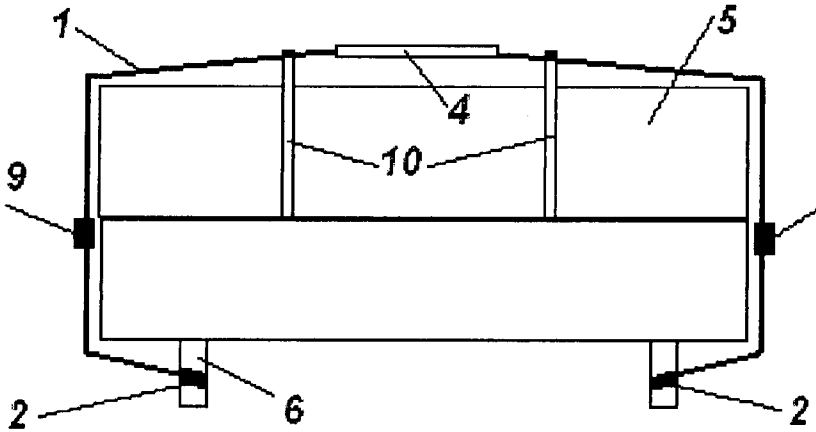
FIG. 3 is an end view of the portable exercise apparatus showing strap ends looped onto the feet of the bed frame, and showing the positioning means.
Figure 4:
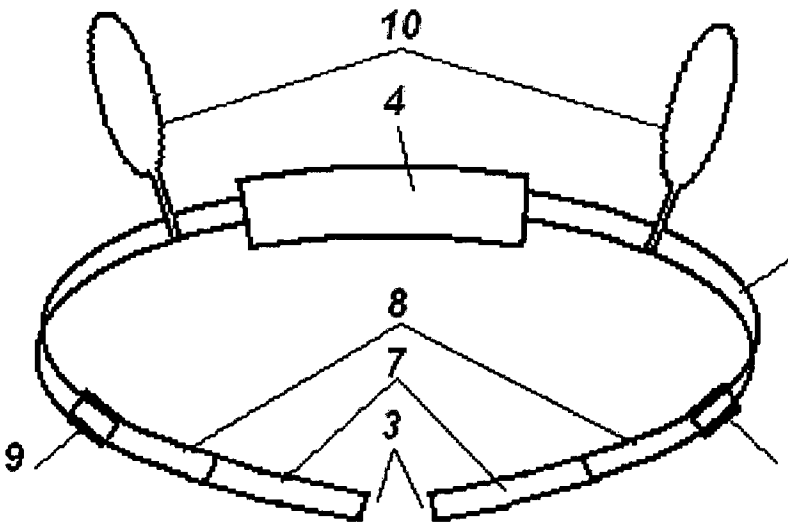
FIG. 4 is an isometric view of the portable exercise apparatus by itself.

The present invention is herein embodied as improvement, which allows primarily for an aid for exercise while a person is prone in bed. Referring first to FIG. 4, shown is the portable exercise device in accordance with the present invention. Device comprises a web strap body 1 and two bed foot 6 engagement loops 2 located at the ends 3 of the web strap 1 body. As is best shown in FIG. 4, web strap body 1 is composed of generally flat, nylon webbing or similar material having a width of approximately 2 inches. Padded element 4 is enclosed within a flexible cover formed from a fabric sheet folded upon itself and brought together about its edges to provide a closed envelope about the element 4. The web strap 1 is of sufficient length that the web strap 1 extends entirely across the width of a mattress 5, as shown in FIG. 3. The web strap 1 extends beyond the edge of the mattress 5, with sufficient length remaining to allow for each end 3 of the strap to drop over the edge of the mattress 5, with sufficient free length to allow for forming a loop 2, with the free ends 3 being secured back onto to the web strap 1 so that the loops 2 thus formed are of suitable opening to capture the foot of a bed frame 6. Each end of web strap 1 is provided with one portion 7 of a hook-and-loop type releasable fastener of the type sold under the trade name VELCRO. A complementary portion 8 of the fastener is affixed to web strap 1 to enable the individual ends 3 of the strap 1 to be detachedly secured to one another. A pair of buckle type belt length adjustors 9 are provided upon the web strap 1, to allow fitment of the apparatus to virtually all sizes of mattresses 5.

The means for positioning 10 can be formed of any suitable material, for example, generally soft ROMEX or other sheathed wire type material. However, the positioning means 10 must be sufficiently firm to prevent the web strap 1 from approaching contact with the mattress 5, to facilitate placing the users feet and ankles under the padded portion 4.

Figure 1:
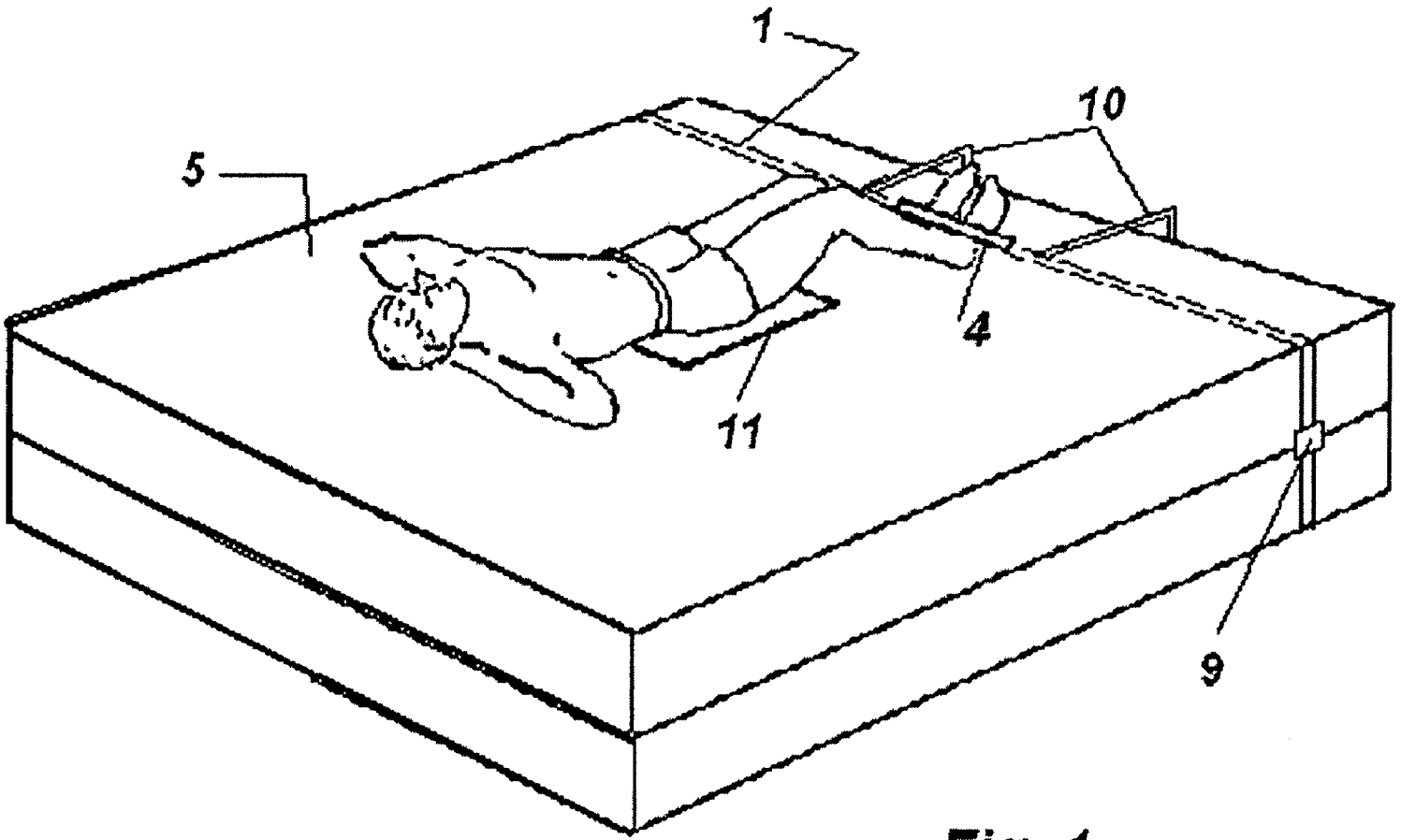
FIG. 1 is a perspective view of the portable exercise apparatus in use, constructed in accordance with the invention and installed in operative position on a mattress.
Figure 2:
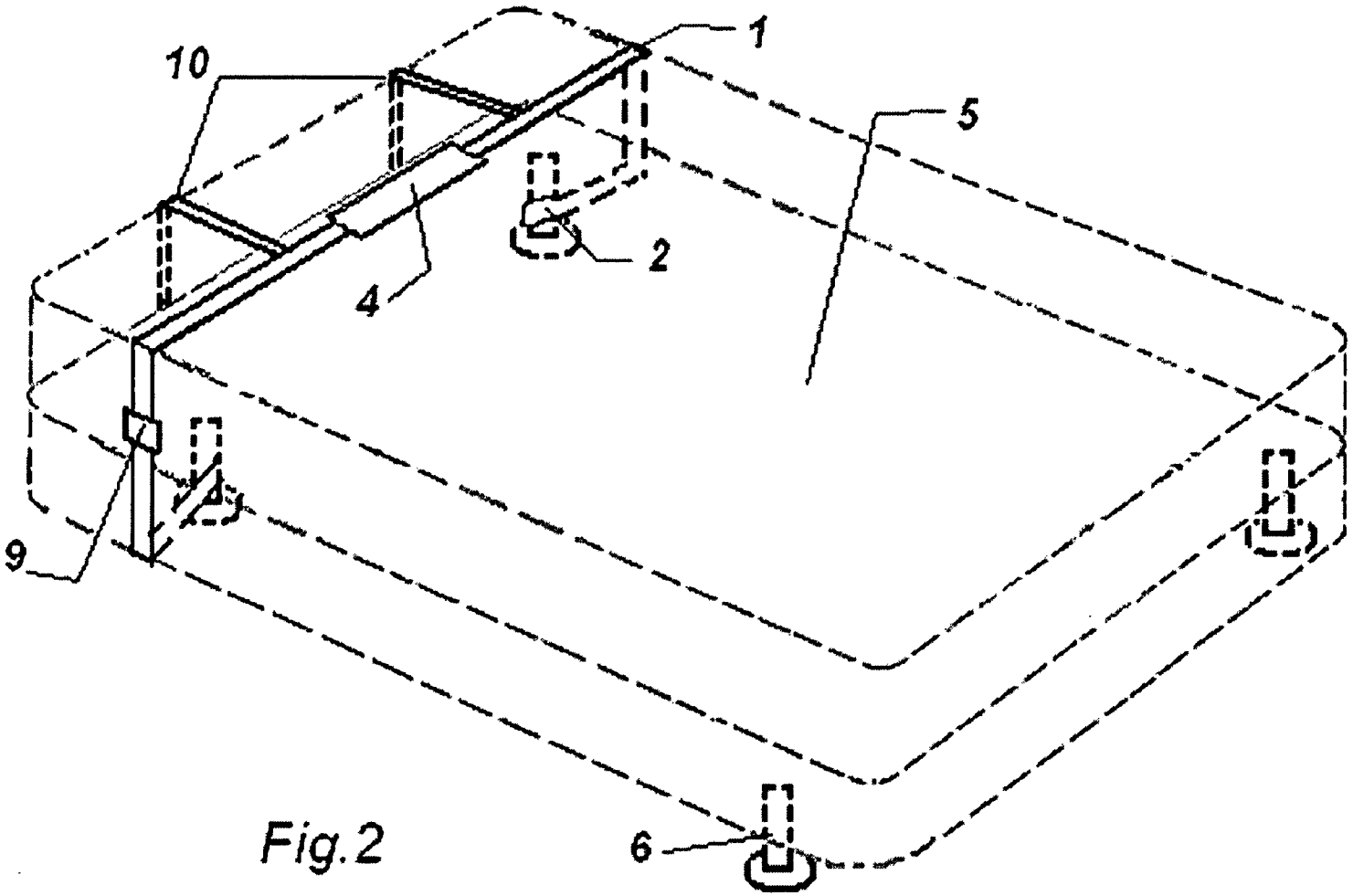
FIG. 2 is a top view of the portable exercise apparatus in position upon a mattress.

As is apparent from the above description, and illustrated in FIG. 2, the exercise device of the present invention is readily installed upon the feet of a bed frame 6, and is easily adjustable so as to provide a comfortable fit about the feet and ankles of a user and is relatively simple in construction. Further, the web strap 1 device provides a solid and safe anchor for the user when performing sit-up type exercises and the like, while the user is-lying prone on his or her back on a mattress 5, illustrated in FIG. 1. When the web strap 1 is fastened as shown, it is reasonably taut, thereby to provide a brace against which the feet and ankles of the user can engage for performing sit-up type exercises. Although the exercise apparatus of the present invention is mainly used for sit-up exercise, it can also be used for stretching muscles. When the apparatus is used for the purpose of stretching, the user reclines on the mattress 5 in a sideways position and engages the padded portion 4 with the feet and ankles in like fashion to sit-up type exercise.

The flat rigid pad 11 assists the user by preventing the user from unduly sinking into the mattress 5 during exercise. During use of the present invention, a user places his or her posterior upon the flat pad 11, an action similar to when one is sitting upon a chair. The rigid pad 11 provides a firm base for the user's posterior when upon the mattress 5. Thus, the motion and energy of the exercise is not transferred into the mattress 5, but rather directed primarily to the muscles involved. It will also be apparent that the material from which the web strap 1 is made is not critical to the practice of the invention concepts. The web strap 1 can be made of cloth, synthetic or natural materials, or other textile materials, or possibly combinations of these. Likewise, the positioning means 10 can be formed of any suitable material, and the means for positioning 10, the flat pad 11, and the web strap 1, if desired, can be coated with a water or stain resistant material which facilitate cleaning and washing.

While there has been shown and described what is considered to be the most practical and preferred embodiment of the present invention, it will be obvious to those skilled in the art that various changes and equivalent arrangements may be made therein without departing from the invention as defined within the spirit and scope of the appended claims.

Having described my invention in such terms as to enable those skilled in the art to understand and practice it, and having identified the presently preferred embodiments thereof, I claim:

1. A portable bed mounted exercise apparatus comprising: a bed comprising a mattress; a flexible webbing strap having two ends, and a length longer than the width of said bed and mattress, the ends of the strap extend downwardly over the sides of the bed and mattress, said strap having an adjusting length for adjusting; a hook-and-loop releasable fastener at both ends of said strap for mounting said strap ends to a frame supporting said bed, said both ends of said strap having one first portion of a hook-and-loop releasable fastener, and a complementary second portion of a hook-and loop releasable fastener affixed to the strap above said first portion; a flexible, padded central section surrounding said strap, said padded section extending at least a substantial width for allowing a user to place both feet underneath said central section while performing abdominal sit ups; a malleable means for positioning adjacent to both ends of said padded section of strap for positioning and spacing said padded central section from the upper surface of mattress; said malleable means for positioning including at least one malleable, flexible loop member extending outwardly from said strap; a flat rigid pad for contact with top surface of said mattress, said pad is approximately 18 inches square, said pad includes means for detachably securing said pad to said mattress top surface, and wherein a user lying in a supine position is adapted for configuration on the top surface of the pad, said flexible webbing strap having an elastic cord projecting from said padded central section as a secondary positioning aid, and wherein said means for positioning increases in width and is encased within said flexible webbing strap, thereby extending said means for positioning substantially along the entire length of said flexible webbing strap.

2. The portable bed mountable exercise apparatus of claim 1, wherein said flexible webbing strap is made of a material selected from the fabric group consisting of nylon, cotton, leather, natural or elastic materials.

3. The portable bed mountable exercise apparatus of claim 1, wherein said flexible webbing strap is provided with snap buckles in lieu of hook-and-loop fastening means.

4. The portable bed mountable exercise apparatus of claim 1, wherein said flat rigid pad is a hollow clamshell configuration storage and carrying case for said strap.

* * * * *